US007143550B1

(12) United States Patent
Lopez

(10) Patent No.: US 7,143,550 B1
(45) Date of Patent: Dec. 5, 2006

(54) DOUBLE NETWORK RETICULATED FRAME STRUCTURE

(75) Inventor: Alfonso Lopez, The Woodlands, TX (US)

(73) Assignee: Conservatek Industries, Inc., Conroe, TX (US)

( * ) Notice: Subject to any disclaimer, the term of this patent is extended or adjusted under 35 U.S.C. 154(b) by 46 days.

(21) Appl. No.: 10/247,046

(22) Filed: Sep. 19, 2002

(51) Int. Cl.
*E04B 7/08* (2006.01)

(52) U.S. Cl. ..... 52/81.3; 52/652.1; 52/654.1; 52/638; 29/891.31; 403/176

(58) Field of Classification Search ..... 52/81.2–81.3, 52/654.1, 655.1, 650.3, 6, 22, 693–696, 652.1, 52/653.1, 638, 646; 29/897.31; 403/176
See application file for complete search history.

(56) References Cited

U.S. PATENT DOCUMENTS 1,908,757 A * 5/1933 Hathorn ..... 52/84
2,433,677 A * 12/1947 Thomas ..... 52/82
3,330,201 A 7/1967 Mouton, Jr.
3,417,520 A 12/1968 Fink
3,486,278 A * 12/1969 Woods ..... 52/81.3
3,635,509 A * 1/1972 Birkemeier et al. ..... 403/173
3,744,206 A * 7/1973 Nelson et al. ..... 52/650.2
4,102,108 A * 7/1978 Cody ..... 52/693
4,178,736 A * 12/1979 Salas ..... 52/653.1
4,201,021 A * 5/1980 Aldag et al. ..... 52/93.1
4,244,152 A 1/1981 Harper, Jr.
4,324,083 A 4/1982 Johnson, Jr.
4,611,442 A 9/1986 Richter
4,698,941 A 10/1987 Rieder et al.
4,939,882 A 7/1990 Filip
5,704,169 A 1/1998 Richter
5,937,589 A 8/1999 Fischer
6,076,324 A 6/2000 Daily et al.
6,205,739 B1 3/2001 Newlin
6,240,694 B1 * 6/2001 Castano ..... 52/653.1

* cited by examiner

*Primary Examiner*—Winnie Yip
(74) *Attorney, Agent, or Firm*—Jenkens & Gilchrist a Professional corporation

(57) ABSTRACT

Structural system and method are disclosed for building a simpler and more efficient double layer reticulated frame structure. The double layer reticulated frame structure includes an internal network that has a lower strut frequency than the external network. The lower strut frequency helps reduce the overall weight, cost, and construction time of the structure. Diagonal struts space apart and connect the internal and external networks. The diagonal struts are connected in an alternating manner such that no more than two diagonal struts are connected together at any point.

46 Claims, 14 Drawing Sheets

DOUBLE NETWORK RETICULATED FRAME STRUCTURE

PRIOR RELATED APPLICATIONS

Not applicable.

FEDERALLY SPONSORED RESEARCH STATEMENT

Not applicable.

FIELD OF THE INVENTION

The invention is related to reticulated frame structures and, more particularly, to a structural system and method for building a dual network reticulated frame structure of the kind used for the construction of stadia and sport arenas.

BACKGROUND OF THE INVENTION

Multi-purpose sports arenas and stadia built around the world are often covered with space frames and lattice structures for weather protection, climate control, and acoustic enhancement. The basic shape of this type of cover, apart from local features of the surface, is usually a portion of a surface of a revolution, such as a portion of a sphere, cylinder, ellipsoid, and the like. Other kinds of surface contours have been and can be used.

One approach to the design of domes or arena roof covers is to use a single network comprised of interconnected structural members, or struts. The struts are located in and define the cover's basic contour surface. Further the struts subdivide the network into a lattice of triangular, rectangular, pentagonal, hexagonal or other polygonal areas. Note that the terms "network" and "surface" may be used interchangeably. Construction of the structural network is simplest when all of the struts in the network are of uniform depth.

However, single layer systems have limited span capabilities due to buckling. The buckling strength of a reticulated space frame is a function of the bending and axial stiffness of the system. For example, a single layer, double curvature aluminum system can span only up to about 400 feet and single layer, single curvature systems (vaults) are limited to about 200 feet. Moreover, these span capabilities are only for structures with relatively high rise-to-span ratio (e.g., 0.3 or higher). For flatter systems, the span capabilities are substantially reduced. In fact, for a single layer system, the buckling strength is inversely proportional to the surface radius of curvature (squared).

While in the past, roofs with high rise-to-span-ratio were acceptable to architects and designers, the current trend is to design arena roofs with low profiles. Low profile roofs have the advantage of minimizing the "amount of air under the roof" and therefore are more efficient from an HVAC design point of view. Additionally, many architects prefer low profile roof systems because of aesthetic considerations. High profile roof systems are undesirable from an aesthetic point of view because they become the predominant element of the building and become an obstacle to changing the building appearance. A low-rise roof system, on the other hand, allows architects to emphasize other elements of the structure.

Double network structures address many of the drawbacks and strength limitations associated with single network structures. In general, because of their higher bending stiffness, double network structures have higher buckling strength and much larger span capabilities than single network structures. As such, large span domes with low rise and large suspended equipment loads (as required by the modern sports arenas) may be safely designed and built using double layer systems. A single curvature double layer system can easily span up to 600 feet. The same system, but used in a structure with double curvature can span up to 900 feet.

U.S. Pat. No. 6,192,634 to Lopez, which is hereby incorporated by reference, describes an example of a double network structural system. The double network system has an inner structural network and an outer structural network. Each network has structural members or struts that are connected at junctions to define the lattice geometry and the shape of the structure. The system junctions have two plates, with the structural struts of each network fastened between top and bottom plates to form moment bearing junctions. Tubular braces are connected according to a desired arrangement between selected outer network junctions and selected inner network junctions. The tubular braces establish a substantially parallel spacing between the networks, and transfer primarily local loads between the networks. The network struts subdivide the outer and inner surfaces into polygonal areas, which are typically of a uniform kind in the outer network. The outer network openings can be closed by using closure panels which laterally stabilize the outer network struts and structurally enhance the network.

A similar double network dome is described in U.S. Pat. No. 5,704,169 to Richter, which is also hereby incorporated by reference. The basic shape of a large span dome in this patent is defined by an external network of structural struts which are so arranged between their junctions that they fully triangulate the surface of the dome. The struts throughout the network have substantially uniform cross-sectional dimensions and are sized to withstand the loads encountered at and near the perimeter of the dome. The central portion of the network is strengthened to withstand snap-through failure by means of a truss system comprised of an internal network and a system of trusses that connect the internal network to the dome outer surface. The internal network lies in a surface which is inside the dome and is uniformly spaced apart from the dome's triangulated surface. The external and internal networks are connected by tie struts which extend between connections at mid-span of inner surface struts and adjacent outer surface strut junctions and which lie in the planes defined by the webs of respective struts. The assembly of the tie struts to the strut junctions can be achieved by use of the same fasteners which connect the struts to their junctions.

The span capability of double layer structures, while greater than single layer structures, is still limited by a number of factors. These factors include the size of the upper layer struts, the size of the lower layer struts, the size of the diagonal struts, the frequency of the upper and lower layers, and the ability of the connections to transfer force. The ability of structural members and connections to transfer force is often the main factor limiting the span capability of systems such as those developed by Lopez and Richter.

In Richter and Lopez type systems, the pipes that connect the upper and lower layers rely on welded connections between the pipes and the triangular connector plates and they share the connection bolts of the main layer struts. Welding of aluminum is not only costly, but significantly weakens the parent metal and makes the area adjacent to the weld brittle. The allowable stresses of the heat-affected zone of a welded connection are typically reduced by 50% for aluminum. Furthermore, the pipe attachment method used by Lopez and Richter type systems results in a very crowded joint. The crowded joint limits the size of the pipe that can be used between the upper and lower networks. As such, these systems have limited capacity to transfer loads between networks (due to the reduced pipe size and welded connection strength), and have limited bending strength due to the system depth limitations that result directly from the pipe size limitation.

The limited load carrying capacity of the diagonal pipe strut connections in Richter and Lopez type systems limits the system depth and the ability of designers to optimize them. For example, the strut frequency of the upper layer (i.e., the number of struts in a given area) is controlled by the size and type of closure panels used. The lower layer, on the other hand, is not controlled by the closure panels and can often be of a lower strut frequency without sacrificing structural integrity. By reducing the lower layer frequency, the load carried per lower layer strut and by the diagonal connectors is increased, thereby making more efficient use of the struts and connectors. A system with a low load carrying capacity in one of its elements cannot be effectively optimized. An optimum double layer system is one that maximizes the load carrying capacity of the upper and lower layer struts, minimizes the number of diagonal connectors, minimizes the total number of joints and components, and makes efficient use of the load carrying capacity of the joints. As a result of the low load carrying capacity of the pipe connections, the use of Lopez and Richter type systems in the design of large span structures often result in structures that have a less than optimum number of joints and struts.

While existing double network designs address some of the problems associated with single network structures, the double network structures themselves are not without drawbacks and shortcomings. For example, presently available double network structures often make inefficient use of struts, joints, and network depth. These structures often contain more struts and joints than is required for the structure to maintain a sufficient degree of stability. In addition to making the structure heavier, the extraneous struts may increase the number of connections required at the nodal joints, resulting in an overly complicated system.

Accordingly, it is desirable to provide improved double layer systems that can expand the span capabilities and shape flexibility beyond those of existing single layer systems and to expand the span capabilities and efficiency beyond those of existing double layer systems. Specifically, it is desirable to provide a structural framing system that allows for optimization of the frequency of the lower layer network and connector grid and allows for minimization of the overall number of struts and joints, while maintaining the required degree of structural stability. In addition, the struts in such a structural framing system should be connected to each other in a manner so as to simplify the joints and assembly thereof.

SUMMARY OF THE INVENTION

The invention is related to a structural system and method for building simpler and more efficient double network reticulated frame structures. The double network reticulated structural system of the invention includes a reticulated external network and a reticulated internal network that has a lower strut frequency than the external network, and substantially the same nodal frequency and connectivity pattern as the external network. The internal and external networks are substantially parallel to each other and are separated by a plurality of diagonal struts. The lower strut frequency of the internal network helps reduce the number of diagonal connectors and the overall weight, manufacturing cost, and construction time of the structure. The diagonal struts are connected to the inner and outer networks in an alternating manner along two directions to define a two-way grid such that diagonal struts in one direction are not directly connected to diagonal struts in the other direction. By connecting the diagonal struts in such an alternating pattern, no more than two diagonal struts intersect the external or internal network at any given joint.

BRIEF DESCRIPTION OF THE DRAWINGS

A more complete understanding of the invention may be had by reference to the following detailed description when taken in conjunction with the accompanying drawings, wherein.

DESCRIPTION OF EMBODIMENTS OF THE INVENTION

Figure 1:
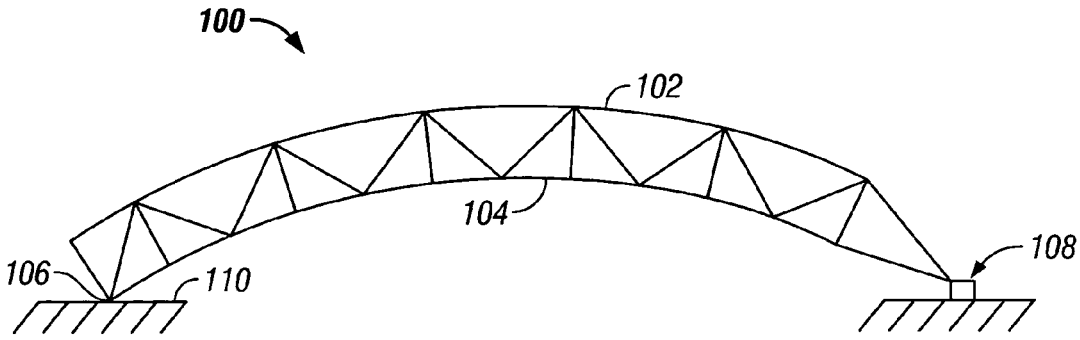
FIG. 1 illustrates a side view of a reticulated frame structure according to embodiments of the invention.

Following is a detailed description of exemplary embodiments of the invention wherein reference numerals for the same and similar elements are carried forward throughout the various figures. It should be noted that the figures are provided here for illustrative purposes only and should not be taken as drawn to any particular scale.

Referring now to FIG. 1, a side view is shown of an exemplary reticulated frame structure 100 according to embodiments of the invention. As can be seen, the reticulated structure is a double network structure that includes an external network 102 and an internal network 104. The external network 102 and internal network 104 are usually similarly shaped so that a curvature at any corresponding points on the network surfaces is defined by the same center of curvature. The curvature of the reticulated frame structure 100 may be a constant, single curvature of the kind that might be used in a roof for a stadium, sporting arena, and the like. Other configurations typically used for these applications may also be used, such as a double curvature configuration, or a no curvature (i.e., flat) configuration.

A plurality of diagonal struts separate the external and internal networks 102, 104. The separation between the networks is usually small (in the range of 25 feet) when compared to the overall size of the reticulated frame structure 100. Although only diagonal struts are shown here, in some embodiments, it is possible to add vertical struts between the external network 102 and internal network 104 for very highly loaded systems. The periphery of the reticulated frame structure may be supported at the external or internal network, or in some embodiments, one or both sides of the periphery may taper to a hinged connection such as the hinged connection 108 that can be used to rotate the reticulated frame structure 100 during assembly. The support point 106 and the hinged connection 108 (where applicable) are supported on a foundation 110 or other similar support structure. For some applications, the support structure 110 or a portion thereof may be movable, for example, slid along a rail system (not expressly shown).

Figure 2:
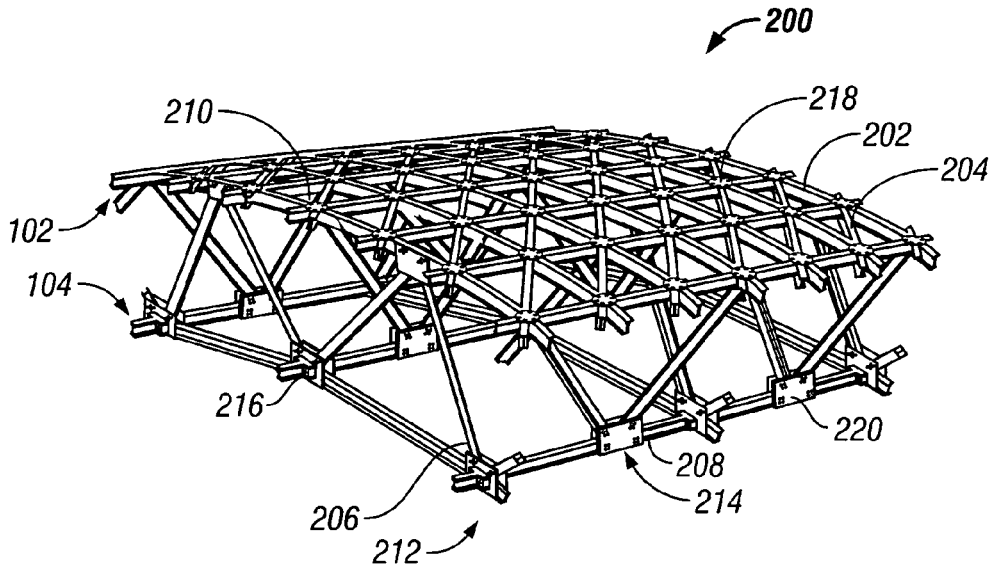
FIG. 2 illustrates a portion of a reticulated frame structure according to embodiments of the invention.

FIG. 2 is a perspective view of a portion 200 of the reticulated frame structure 100 shown in FIG. 1. As can be seen, each of the external and internal networks 102, 104 are made of interconnected structural framing members, referred to herein as struts. There are two types of struts in the external network 102, namely, chord struts 202 and intermediate lattice struts 204. The chord struts 202 are the struts that define the main geometry of the external network 102. The intermediate lattice struts 204 define the openings in the external network 102. The internal network 104, on the other hand, only has chord struts 208. Some of the chord struts 202, 208 in both networks have diagonal struts 206 connected thereto.

In the external network 102, the chord struts 202 extend along two main directions that are perpendicular or nearly perpendicular to each other to form a two-way grid. The two-way grid has the same geometric shape (though not necessarily the same size) as the two-way grid defined by the chord struts 208 of the internal network 104. Stated another way, the external network grid geometry, as defined by its chord struts 202, matches the internal network grid geometry, as define by its chord struts 208. The external network grid can be defined by projecting the internal network chord struts 208 onto the external network surface through the local center of curvature.

The other structural framing members in the external network 102 are the intermediate lattice struts 204. Intermediate lattice struts serve to define a lattice grid within the two-way grid of the outer network 102. The intermediate lattice struts divide the outer network 102 into a plurality of openings 210. The openings 210 may be substantially triangular as shown, or they may assume some other shape, as will be described later herein. There are no intermediate lattice struts 204 in the internal network 104, only chord struts 208, some of which have diagonal struts 206 connected.

The diagonal struts 206 serve to space apart the two networks 102, 104. In accordance with embodiments of the invention, the diagonal struts 206 are connected along two directions in an alternating pattern. The points where the diagonal struts 206 connect to the networks 102, 104 are the nodes 212 and the chord midsections 214. A node 212, for purposes of this description, is any point where a chord strut extending in one direction of the two-way grid connects with a chord strut extending in the other direction of the two-way grid in the external and internal network 102, 104. A chord midsection (or mid-chord) 214 can be any point along the length of a chord strut 202, 208, but is usually located around the middle of the chord strut. In accordance with embodiments of the invention, the diagonal struts 206 that connect to a node 212 in the internal network 104 are also connected to a mid-chord 214 in the external network 102. Likewise, the diagonal struts 206 that are connected to a node 212 in the external network 102 are also connected to a mid-chord 214 in the internal network 104. However, not all chord struts 202, 208 will have diagonal struts 206 connected at their midsections 214. In fact, in some embodiments, the frequency of the chord struts 202, 208 in the external and internal networks 102, 104 may be changed so that the diagonal strut connections always occur at a node 212 instead of sometimes at a mid-chord 214.

As a result of the alternating pattern, the diagonal struts 206 along one direction are not connected to (i.e., do not meet) the diagonal struts 206 along the other direction except where needed, for example, along the edges or periphery of the reticulated frame structure 100. An advantage of the above arrangement is that typically only two diagonal struts 206 connect at a joint. Having only two diagonal struts 208 connect at a joint greatly simplifies the joint design relative to a joint that has to accommodate a higher number of diagonal struts 206. In addition, for single curvature and spherical arrangements, each diagonal strut 206 is contained in a plane defined by the upper and lower chord struts to which the diagonal strut 206 is connected. Aligning the diagonal struts 206 to the connecting chord struts 202, 208 simplifies any mid-chord joint or nodal joint design used to connect the diagonal struts 206, and also simplifies the process of connecting the diagonal struts 206.

At each node 212, the connection between the chord struts 202, 208 and the diagonal struts 206, either in the external network 102 or the internal network 104, is made with a nodal joint 216. The nodal joint 216, if in the external network 102, may also have one or more intermediate lattice struts 204 connected thereto. Non-nodal connections are made using intermediate joints 218, which connect the intermediate lattice struts 204 and the chord struts 202, 208, where applicable (not all intermediate joints connect to chord struts), but not the diagonal struts 206. Diagonal struts 206 that meet at a midsection 214 of a chord strut 202, 208 are connected with a mid-chord joint 220. The various joints are described in more detail later herein.

In accordance with embodiments of the invention, the internal network 104 has a significantly lower overall strut frequency than the external network 102, but substantially the same nodal frequency and similar nodal connectivity pattern as the external network 102. The strut frequency is the number of struts that are present within a given area of a network. Likewise, the nodal frequency is the numbers of nodes present within a given area of a network.

The significantly lower strut frequency of the internal network 104 provides a more efficient structural framing system relative to existing designs. For example, fewer chord struts 208 in the internal network 104 decreases the number of struts, number of joints, and amount of material required to construct the reticulated frame structure 100. The strut, joint, and materials reduction can result in a lower overall weight of the structure 100, thereby decreasing the overall cost of the structure and the loads on the foundation 106 (see FIG. 1) or other support structure. In addition, fewer connections between struts have to be made during construction, thereby reducing the construction cost of the structure and shortening the construction time.

Furthermore, the chord struts 208 used in the internal network 104 may be longer than the ones in the external network 102, since there are, no intermediate lattice struts 204 to be connected in the internal network 104. The use of longer chord struts in the internal network 104 reduces the overall number of chord struts and nodal joints in the reticulated frame structure. In general, where the weights of two structures are similar, the one with fewer components will be more economical to manufacture. The simplicity of the system also results in reduced detailing and manufacturing costs. All of these factors can result in reduced detailing, manufacturing, and construction costs as well as decreased maintenance and repair costs over the life of the reticulated frame structure 100. Depending on the application, however, there is a strut frequency limit for the internal network below which the chord struts required would become too heavy, and the field construction and material handling costs required to handle heavier components would outweigh the savings due to the reduced number of components.

The internal network can be designed with a lower strut frequency without compromising the stability or altering the overall strength of the reticulated frame structure 100. One reason is because the frequency of the external network 102 is typically controlled by the paneling system (described later herein), whereas there is no such restriction on the internal network 104. As such, designers are free to optimize the length and weight of the lower chord struts while still accounting for construction and manufacturing weight constraints. In addition, the struts of the internal network 104 do not have to provide local support to environmental loads (such as snow loads). These environmental loads, however, act normal to the struts of the external network 102 and induce local bending stresses on the external network struts. This force disparity between the external and internal network struts requires that the frequency of the internal network 104 be lower in order to achieve an efficient design.

Moreover, for live or other uniformly distributed gravity loads such as uniform snow loads (particularly in low rise single curvature systems) many of the internal network struts are subjected to either axial tension forces or reduced compression forces due to overall bending of the shell. The design of struts subjected to axial tension forces requires a smaller amount of material compared to the design of struts subjected to compression forces. Thus, because the external network has to support the cladding system and is typically subjected to both high local bending stresses and high compression forces, significantly fewer struts are required to support the forces acting on the internal network. Therefore, the number of struts that are actually needed in the internal network 104 is fewer than in the external network 102. Accordingly, a more efficient structure may be realized by using a significantly smaller number of struts in the internal network 104. In some embodiments, it is possible to use struts of lighter material (e.g., aluminum), or struts with a smaller cross-section in the internal network 104, depending on the particular application. If desired, additional stabilization of the lower chord struts may be achieved by connecting adjacent and/or opposing chord struts 208 in the internal network 104 with steel cables (not expressly shown) at the midsections 214.

Figure 3A:
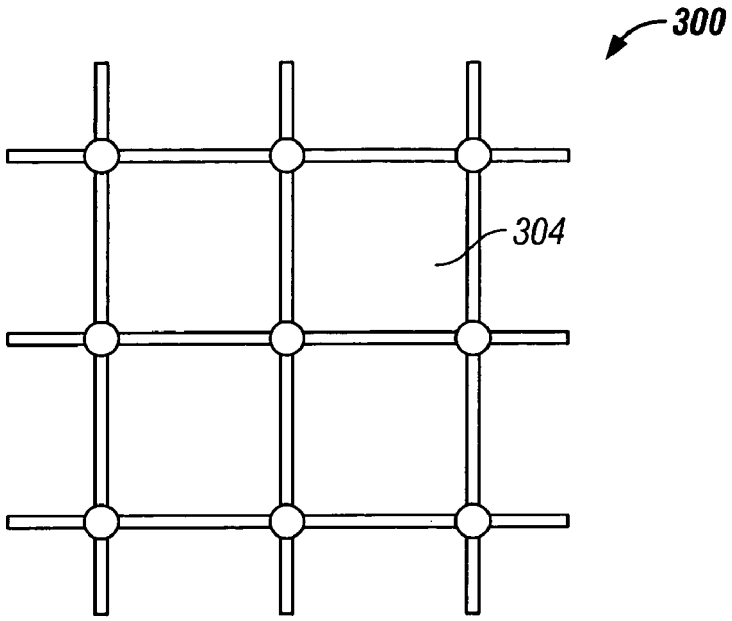
FIG. 3 illustrates an exemplary external network and internal network according to embodiments of the invention.
Figure 3B:
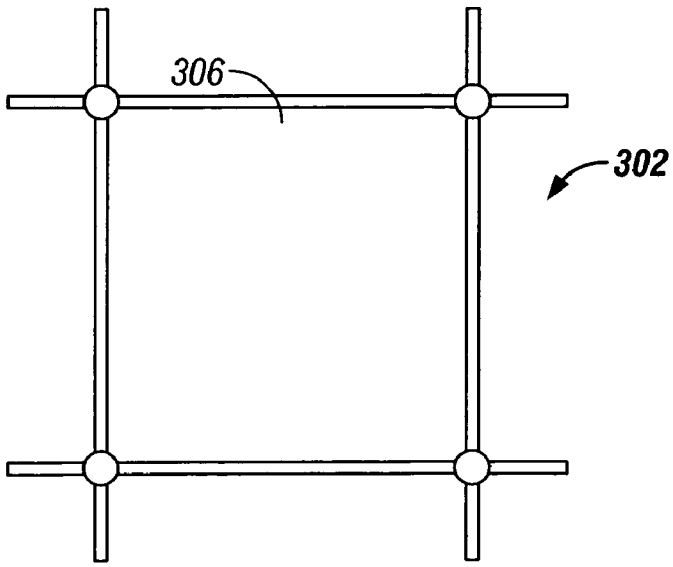
Figure 4A:
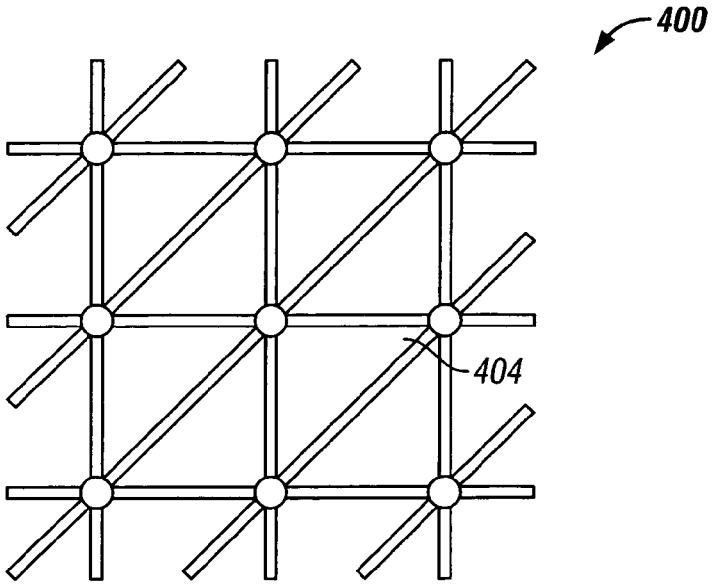
FIG. 4 illustrates another exemplary external network and internal network according to embodiments of the invention.
Figure 4B:
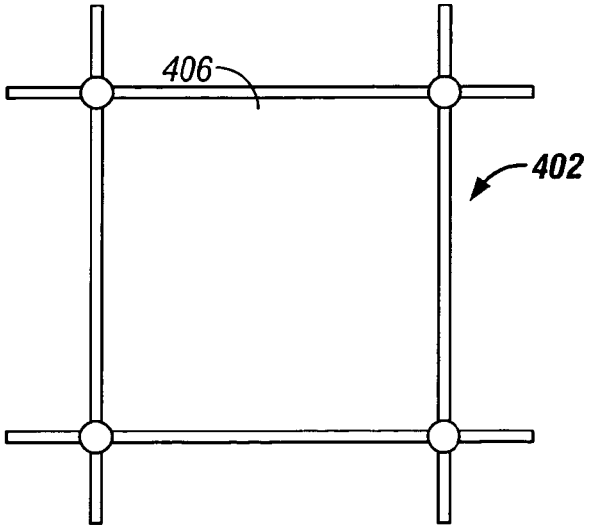
Figure 5A:
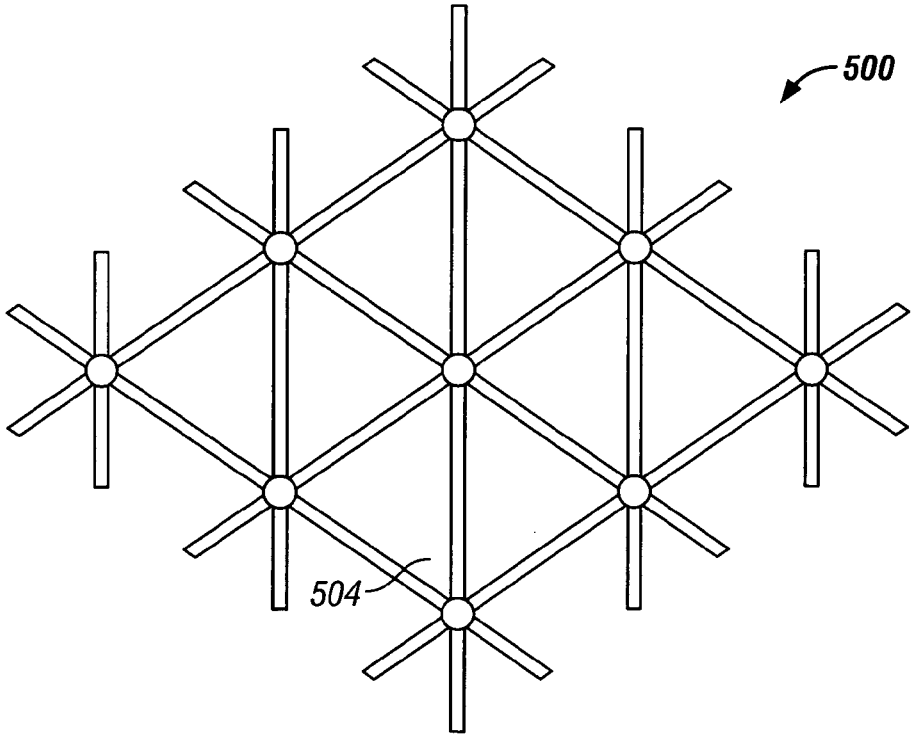
FIG. 5 illustrates another exemplary external network and internal network according to embodiments of the invention.
Figure 5B:
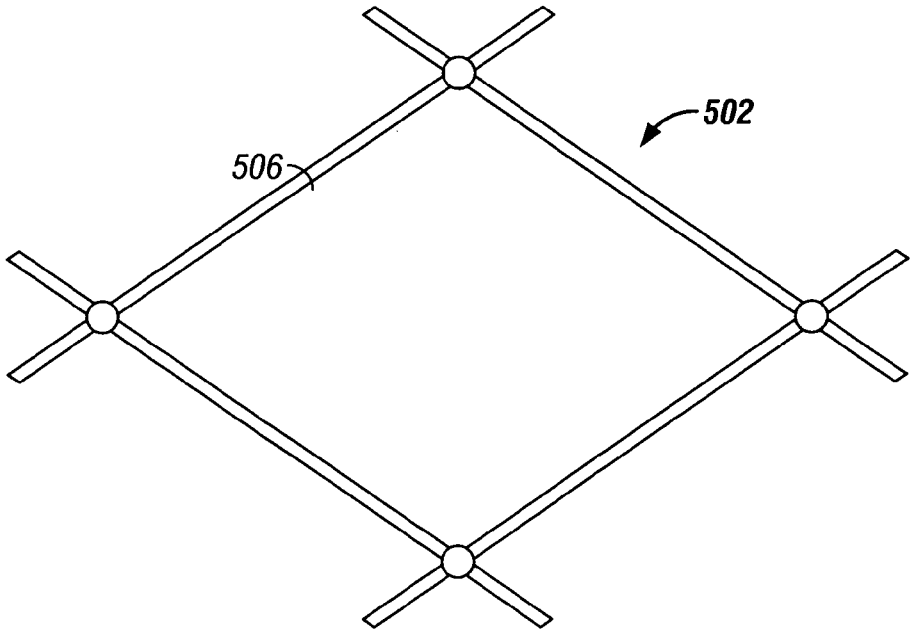

FIGS. 3–5 illustrate several exemplary configurations of external and corresponding internal networks. In these figures, the diagonal struts 206 and the mid-chord joints 220 therefor are not shown in order to avoid unduly cluttering the figures. Referring now to FIG. 3, a portion of an external network 300 and an internal network 302 are shown. The external network 300 has been divided into a number of substantially rectangular openings 304. The internal network 302 has likewise been divided into a number of substantially rectangular, somewhat larger openings 306. The number of openings 304 in the external network 300 is different than the number of openings 306 in the internal network 302 resulting in substantially different strut frequencies. In the embodiment of FIG. 3, the number of openings 304 in the external network 300 is higher by a ratio of approximately 4:1. This ratio is exemplary only, however, and may be selected as needed (e.g., 2:1, 2.5:1, 3:1, 3.5:1, 4.5:1, 5:1, 8:1, 10:1, and the like). Note that odd ratios (e.g., 2.5:1, 3.5:1, etc.) are possible only for non-symmetrical networks such as networks with rectangular openings.

FIG. 4 illustrates a similar arrangement to FIG. 3 in that there is an external network 400 having higher strut frequency and an internal network 402 having a lower strut frequency. In FIG. 4, the external network 400 has been divided into a plurality of substantially right triangular openings 404. The somewhat larger openings 406 in the internal network 402, however, are still substantially rectangular. The right triangular openings 404 serve to increase the ratio of openings between the two networks 400, 402 to 8:1. In this manner, the load carrying capacity and strut frequency of the external network 400 has been increased without a corresponding increase in the strut frequency of the internal network 402.

In FIG. 5, the external network 500 and the internal network 502 are configured slightly differently than in the previous two embodiments. In this exemplary configuration, the external network 500 has been divided into a plurality of equilateral triangle shaped openings 504. The internal network 502 has been divided into a plurality of parallelogram shaped openings 506. The ratio of the openings 504, 506 between the two networks 500, 502 in this embodiment is also 8:1, but the equilateral triangle shaped openings 504 in the external network 500 provide a somewhat different appearance to the reticulated structure compared to previous embodiments.

From FIGS. 3–5, it can be seen that no particular configuration is required for the external and internal networks. That is to say, no set shape is required for the openings in the external and internal networks, and no set ratio is required for the number of openings between the networks. Moreover, it is possible to use different shape openings in the external network than in the internal network, depending on the needs of the application.

Figure 6A:
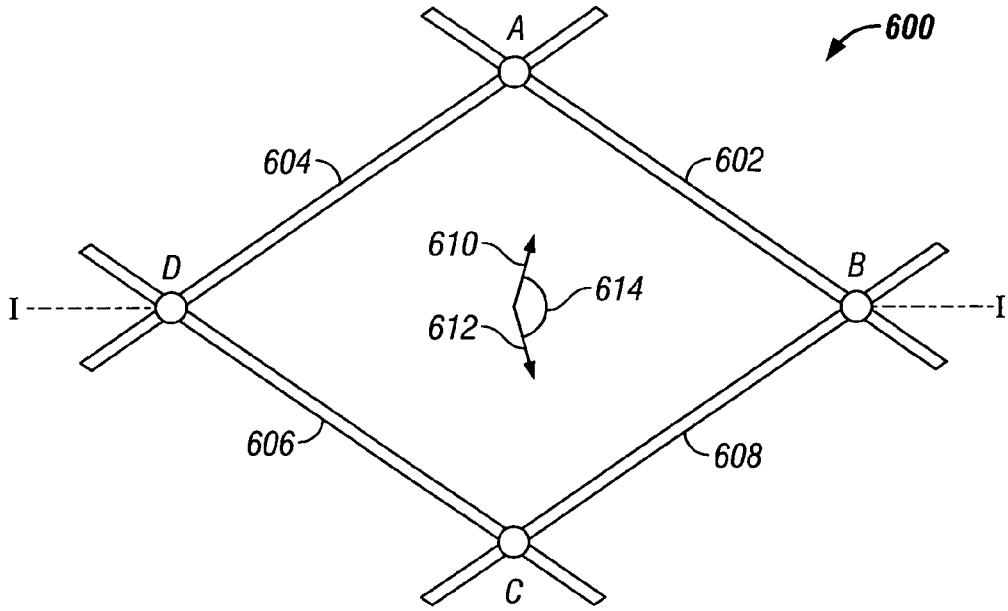
FIGS. 6A–6B illustrate an exemplary chord strut opening according to embodiments of the invention.

FIG. 6A illustrates a trapezoidal opening 600. The opening 600 may represent an opening in either the internal network or in the chord geometry of the external network. In the internal network, each of the sides 602–608 is comprised of one chord strut, for a total of four chord struts. In the external network, each of the sides 602–608 may be comprised of two or more interconnected chord struts, for a total of at least eight chord struts. In the case of the external network, the opening 600 would also include a number of triangulated in-fills (e.g., two, four, eight). The triangulated in-fills would be formed by one or more intermediate lattice struts, which may be in the same plane or in different planes depending on the particular application.

In accordance with embodiments of the invention, the chord struts for the first and second sides 602, 604 define one plane, indicated by the arrow 610, while the chord struts for the third and fourth sides 606, 608 may define a different plane, indicated by the arrow 612. This can be accomplished by moving node A out of the plane defined by nodes B, C, and D. The result is that the opening 600 is bisected along an imaginary line I—I into two planes. Such an opening 600 can facilitate the construction of reticulated frame structures that have a single curvature. An angle 614 is formed by the two planes 610 and 612, the size of which can vary and depends on the degree of curvature desired for the structure.

Figure 6B:
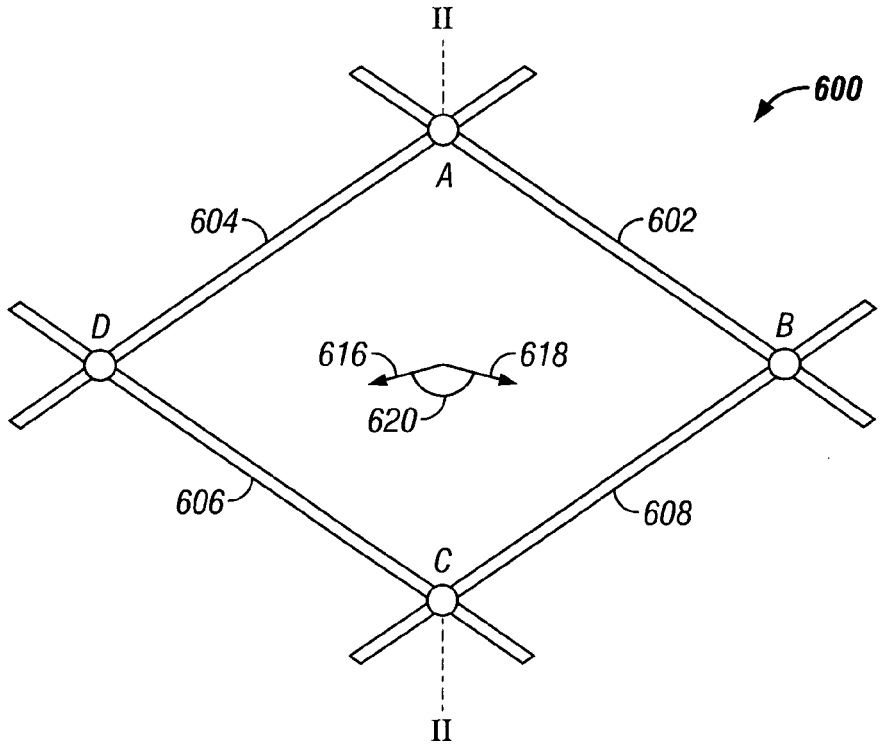

A double curvature structure can be formed by moving node D out of the plane defined by nodes A, B, and C, in addition to moving node A as described above. This can be better seen in FIG. 6B, which only shows the bisection along line II—II for clarity purposes. In this case, the chord struts for the second and third sides 604, 606 define one plane, indicated by the arrow 616, while the chord struts for the first and fourth sides 602, 608 may define a different plane, indicated by the arrow 618. An angle 620 is formed by the two planes 616 and 618, the size of which can vary and depends on the degree of curvature desired for the structure. Note that curvature can also be created by rotating any strut away from the surface defined by the grid of struts at any connecting joint.

Figure 7A:
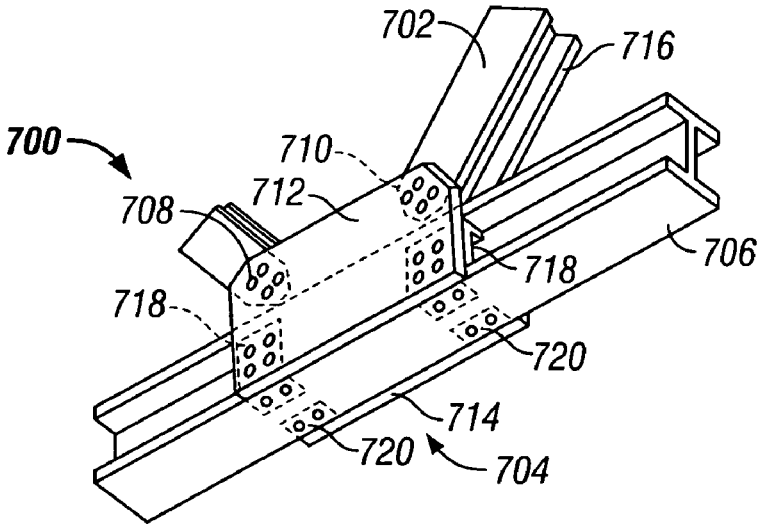
FIGS. 7A–7C illustrate a mid-chord joint according to embodiments of the invention.
Figure 7B:
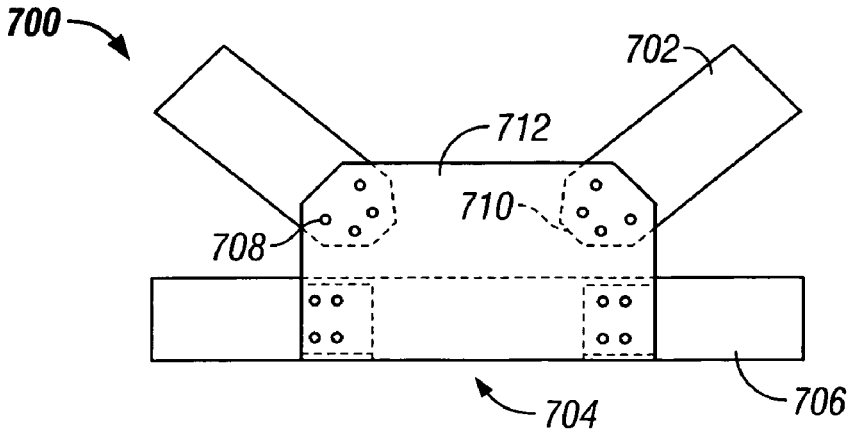

FIGS. 7A and 7B illustrate an exemplary mid-chord joint 700 is similar to the mid-chord joints 220 shown in FIG. 2. As can be seen, the exemplary mid-chord joint 700 is for a connection in the internal network 104. An external network mid-chord joint is essentially the same except upside-down and, therefore, is not expressly shown here. The mid-chord joint 700 can be used to connect two diagonal struts 702 to a midsection 704 of a chord strut 706. In some embodiments, however, instead of a single chord strut 706, it is also possible to use two shorter chord struts. In that case, the mid-chord joint 700, or a joint that is structurally similar to the mid-chord joint 700, may be used to connect the ends of the two shorter chord struts together as well as to the diagonal struts 702. The connections in FIGS. 7A and 7B are made via bolts, screws, nuts, or other similar attachment means, indicated generally at 708.

The diagonal struts 702 and the chord struts 706 shown in FIGS. 7A–7B are I-beams, although pipes, channels, and various extrusion shapes may also be used. The I-beams may be, for example, steel, extruded aluminum, or other suitable materials. Preferably, the end portions 710 of the diagonal I-beams 702 have coped flanges. The mid-chord joint 700 includes a front-side gusset plate 712 and a back-side gusset plate 714. The front-side and back-side gusset plates 712, 714 are configured to connect the diagonal I-beams 702. Specifically, the front-side and back-side gusset plates 712, 714 are configured to connect to the flange portions 716 of the diagonal I-beams 702. Although it is not evident from the figures, in a preferred embodiment, the neutral axes of the diagonal I-beams 702, the chord I-beams 706, and the front-side and back-side gusset plates 712, 714 all intersect at a single point.

Figure 7C:
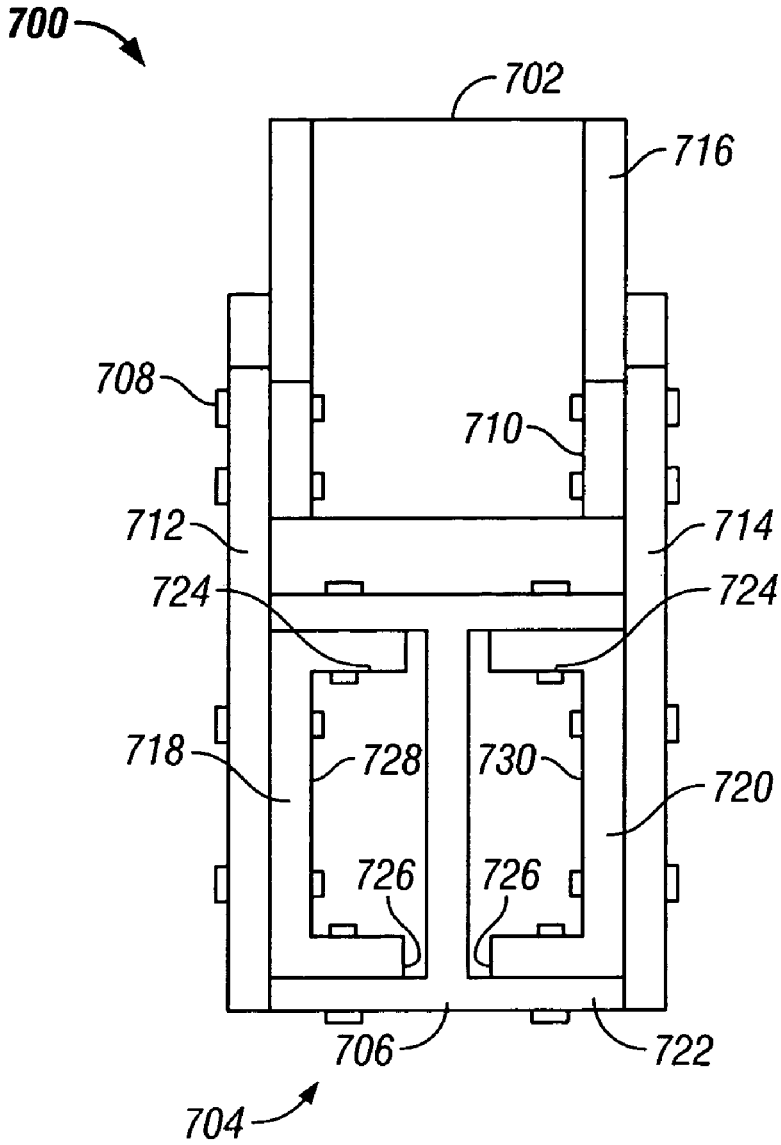

The front-side and back-side gusset plates 712, 714 are also connected to the chord I-beam 706. Connection to the chord I-beam 706 is accomplished with the use of channels 718, 720, as shown in FIG. 7C. The channels 718, 720 in FIG. 7C are the shaded areas. There are four channels per chord I-beam 706 in this embodiment, namely, two front-side channels 718 and two back-side channels 720. Flange portions 722 of the chord I-beam 706 are connected to a top portion 724 and a bottom portion 726 of each channel 718, 720. A web portion 728 of the front-side channels 718 is then connected to the front-side gusset plate 712, and a web portion 730 of the back-side channels 720 is connected to the back-side gusset plate 714. The result is any load on the diagonal I-beams 702 will be transferred to the front-side and back-side gusset plates 712, 714, and hence, to the chord I-beams 706. The gusset plates also balance the load on the diagonal I-beams, resulting in zero resultant load.

Figure 8:
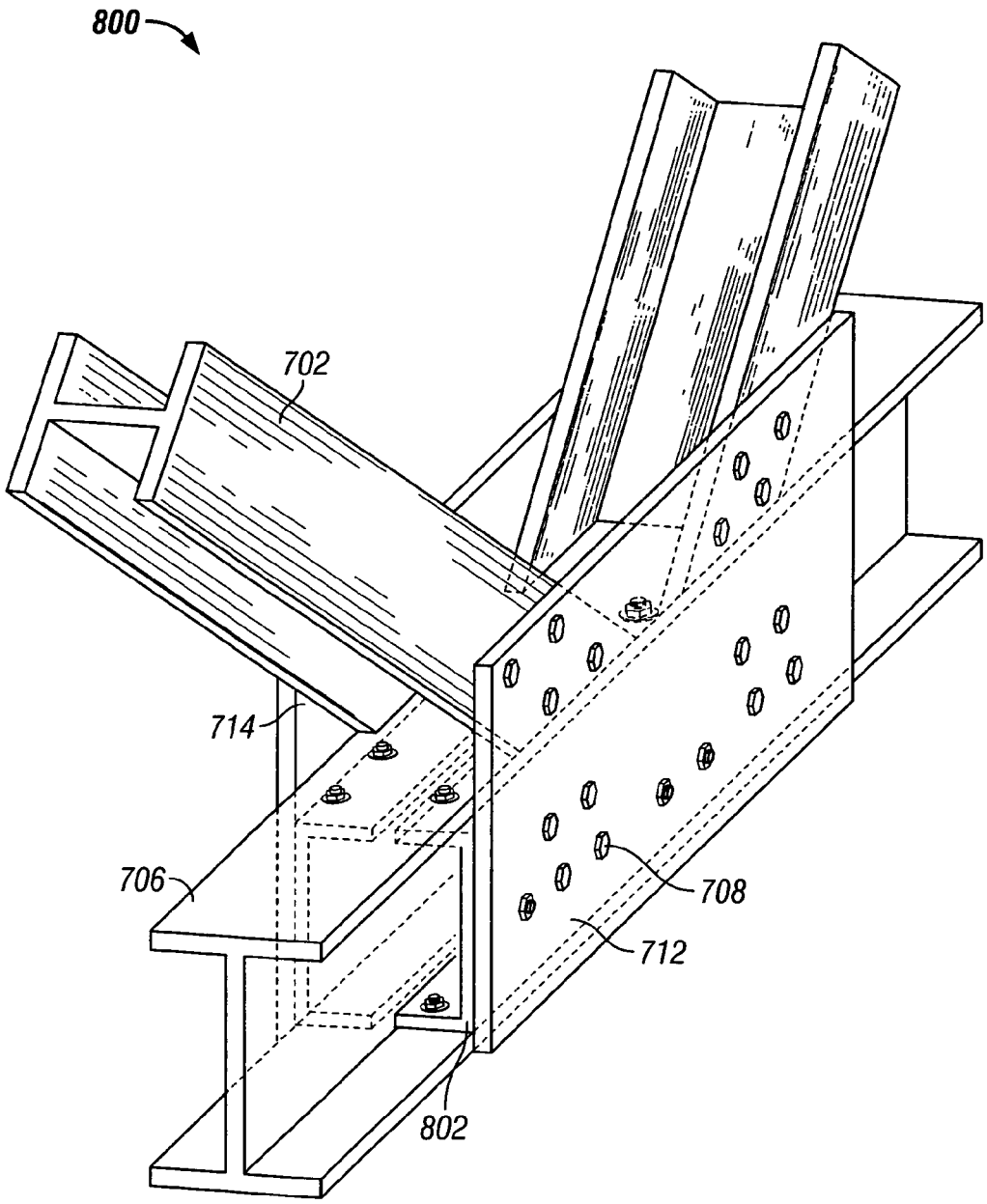
FIG. 8 illustrates another mid-chord joint according to embodiments of the invention.

The above FIGS. 7A–7C are exemplary only, and variations therefrom are certainly possible. For example, instead of the front-side and back-side gusset plates 712, 714 and the channels being separate components, each front-side and back-side gusset plate and the respective channels may be extruded as a single component. Moreover, instead of two channels for each of the front-side and back-side gusset plates 712, 714, there may be a single channel instead. FIG. 8 illustrates a mid-chord joint 800 wherein only a single channel 802 is used to connect each of the front-side and back-side gusset plates 712, 714 to the chord I-beam 706. The diagonal I-beams 702 are then connected to the front-side and back-side gusset plates 712, 714 in the manner described above. Where I-beams are not used, it may not even be necessary to have channels in order to connect the gusset plates to the chord struts.

Figure 9:
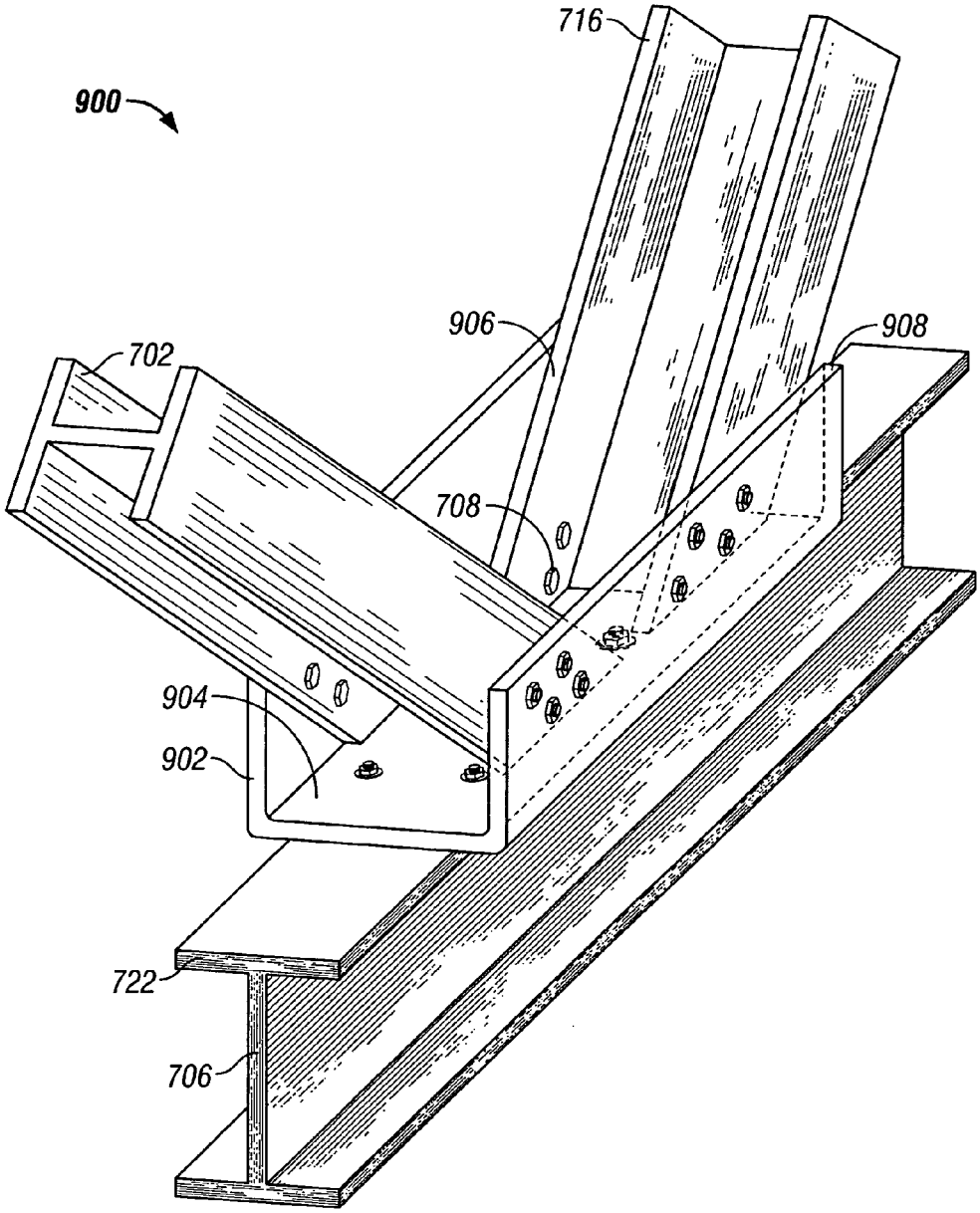
FIG. 9 illustrates yet another mid-chord joint according to embodiments of the invention.

Other embodiments of the invention may use tubular struts, angle brackets, welded plates, and the like to connect the chord I-beam 706 to the side gusset plates 712, 714. Still other embodiments may omit the side gusset plates 712, 714 altogether. FIG. 9 illustrates an exemplary mid-chord joint 900 wherein the front-side and back-side gusset plates have been omitted. In this case, the diagonal I-beams 702 may be connected to the chord I-beam 706 via a single channel 902 affixed to the top flange 722 of the chord I-beam 706. The channel 902 has a web portion 904 and flanges 906. The web portion 904 of the channel 902 is connected to the top flange 722 of the chord I-beam 706 (e.g., via bolts, screws, nuts, or other similar attachment means, indicated generally at 708). The diagonal I-beams 702 are then connected to the flanges 906 of the channel 902 in the manner shown.

Figure 10A:
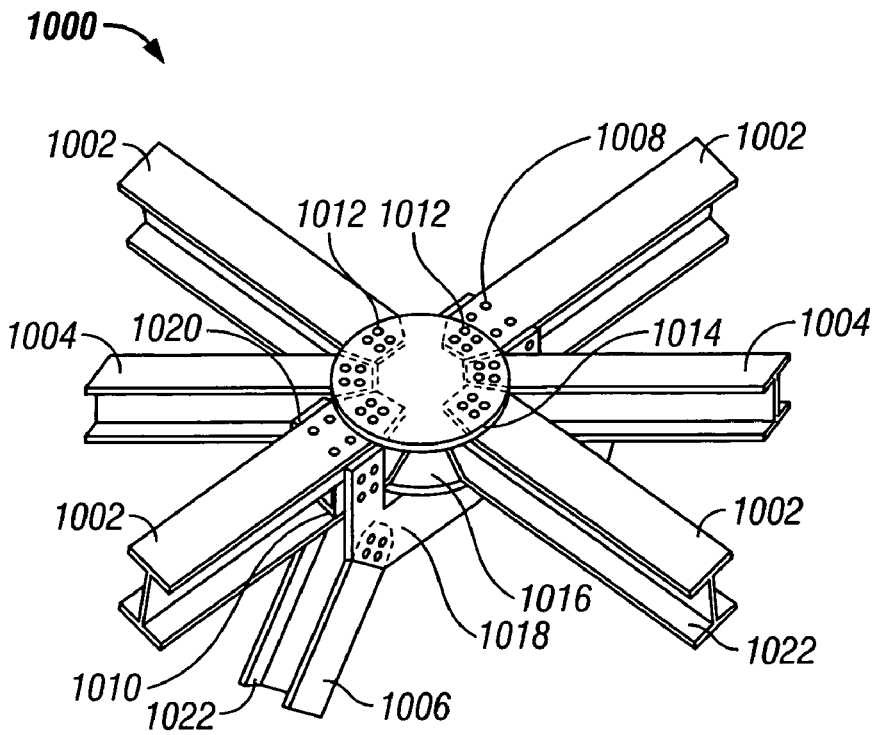
FIGS. 10A–10B illustrate a nodal joint according to embodiments of the invention.
Figure 10B:
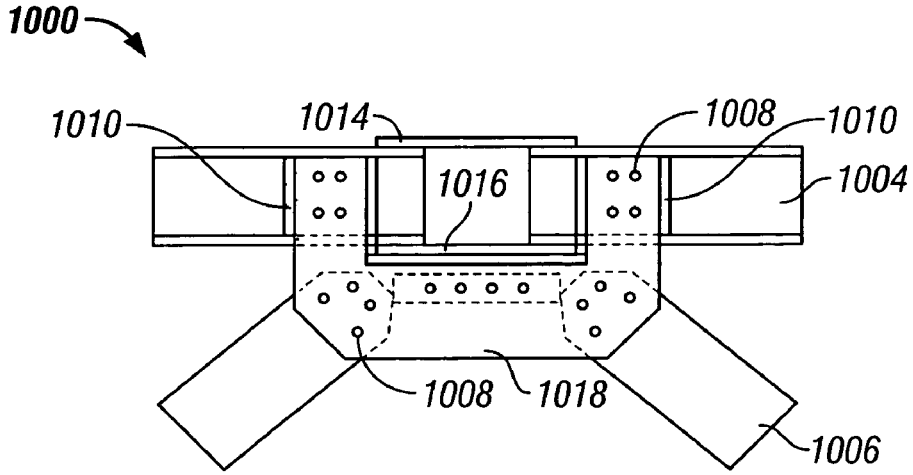

FIGS. 10A and 10B illustrate an exemplary nodal joint 1000, similar to the nodal joint 216 shown in FIG. 2. As can be seen, the exemplary nodal joint 1000 shown here is an external network nodal joint. An internal network nodal joint is essentially the same except upside-down and, therefore, is not expressly shown. The nodal joint 1000 can be used to connect chord struts 1002, intermediate lattice struts 1004, as well as diagonal struts 1006. Note that a nodal joint does not always include all three types of struts; some nodal joints may only include chord struts and intermediate lattice struts, and some nodal joint may only include chord struts. The connections in these two figures are made via bolts, screws, nuts, or other similar attachment means, indicated generally at 1008. The struts 1002, 1004, 1006 shown in FIGS. 10A–10B are preferably I-beams with tapered end portions 1012. The I-beams may be, for example, steel, extruded aluminum, or other suitable materials.

The nodal joint 1000 includes a top gusset plate 1014, a bottom gusset plate 1016, a front-side gusset plate 1018, and a back-side gusset plate 1020. The top and bottom gusset plates 1014 and 1016 are configured to connect the chord I-beams 1002 and the intermediate I-beam 1004 that form the external network. Specifically, the chord I-beams 1004 and the intermediate I-beams 1010 are sandwiched between the top and bottom gusset plates 1014 and 1016, and are connected thereto at their respective flange portions 1022. Likewise, the diagonal I-beams 1006 are sandwiched between the front-side and back-side gusset plates 1018 and 1020, and are connected thereto at their flange portions 1024. Note that the front-side and back-side gusset plates 1018, 1020 provide a moment resistant joint that strengthens the diagonal struts against strut buckling. In embodiments where vertical struts are used between the internal and external networks, the flanges of the vertically running I-beams would be connected directly to the front-side and back-side gusset plates 1018 and 1020 in a similar manner. The front-side and back-side gusset plates 1018 and 1020 are, in turn, connected to the chord I-beams 1002 via a set of channels 1010. The channels 1010 are substantially identical to the channels 718, 720 shown in FIGS. 7A–7C, and are therefore not described separately here.

Figure 11:
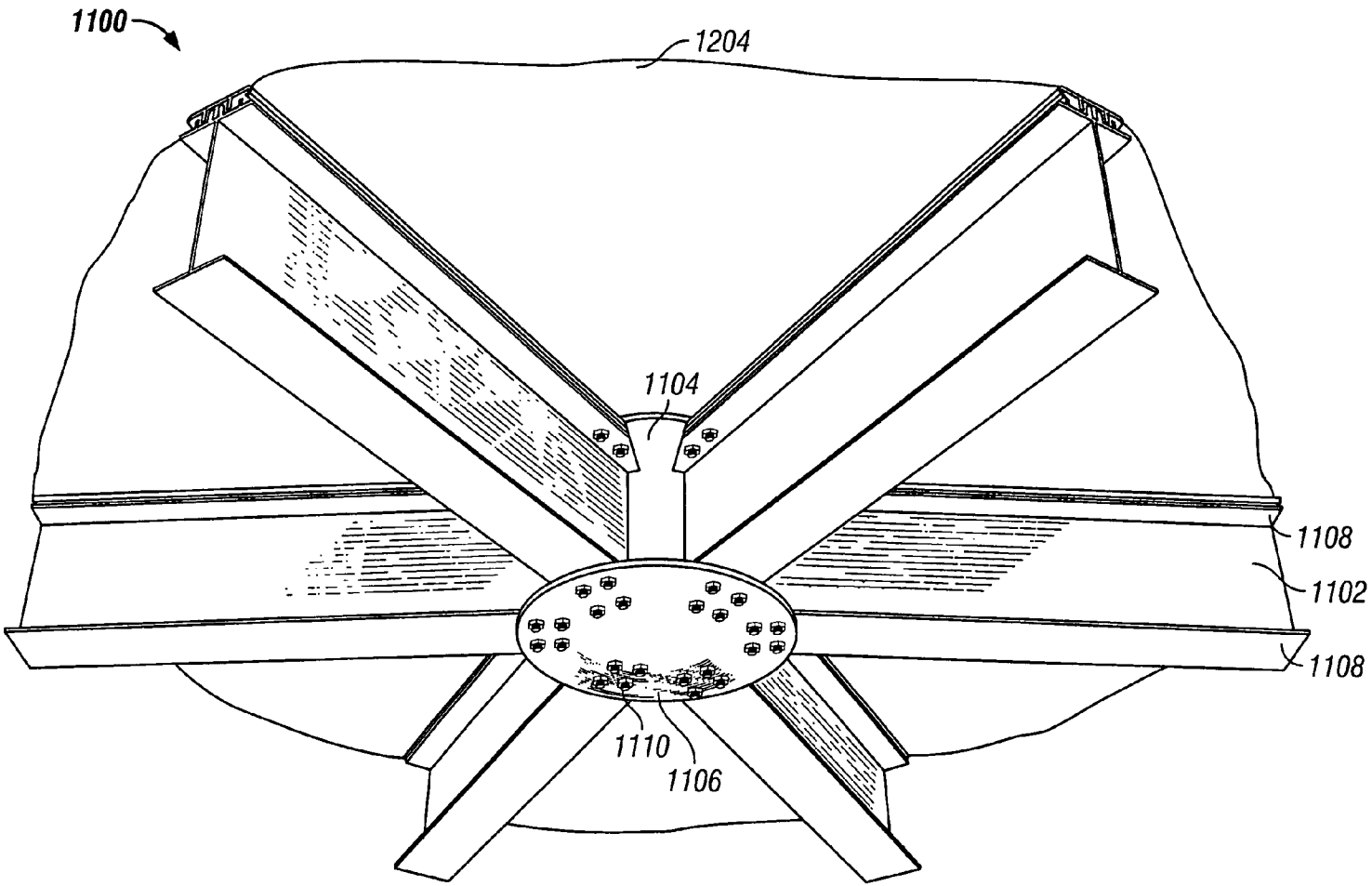
FIG. 11 illustrates a nodal/intermediate joint according to embodiments of the invention.

FIG. 11 illustrates an inside view of an exemplary intermediate joint 1100, similar to the intermediate joint 218 shown in FIG. 2. Note that the intermediate joint 1100 can also be used as a nodal joint for nodes where no diagonal struts are connected. The exemplary intermediate joint 1100 connects intermediate lattice struts 1102 to one another and also to chord struts where applicable. There are no diagonal struts connected to the intermediate joint 1100. In all other respects, the intermediate joint 1100 is essentially the same as the nodal joint 1000. There is a top gusset plate 1104 and a bottom gusset plate 1106, which are configured to connect the intermediate lattice I-beams 1102. Connection to the intermediate lattice I-beams 1102 is made through the flange portions 1108 thereof via bolts, fasteners, nuts, or other similar attachment means, indicated generally at 1110.

The intermediate joint 1100 is also used to integrate a closure system, roofing subsystem, or panel membrane. The closure system, roofing subsystem, or panel membrane typically includes a plurality of cover panels, which may contribute to the structural behavior of the reticulated frame structure. The cover panels can be designed to provide a watertight skin which can be opaque, translucent, or transparent, and can provide environmental protection as well as varying levels of sound insulation. Preferably, the cover panels are mounted in place along the edges of the openings in the external network (see FIGS. 3–5). Panel mounting arrangements described and shown in U.S. Pat. Nos. 3,477,752; 3,909,994; or 3,916,589 can be used if desired, and these patents are hereby incorporated herein by reference.

Figure 12:
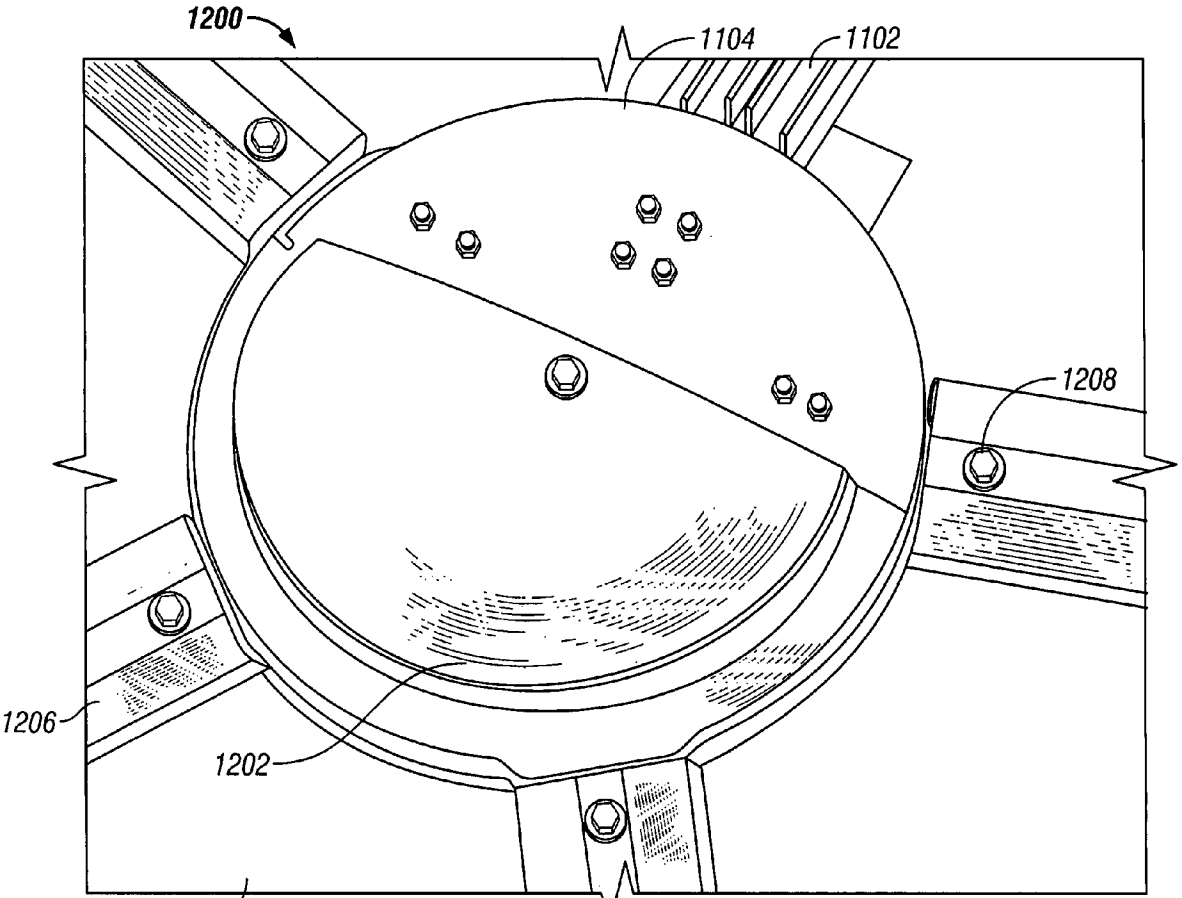
FIG. 12 illustrates a cutaway exterior view of a nodal/intermediate joint according to embodiments of the invention.

An exemplary closure system connection 1200 is illustrated with a cut-away exterior view in FIG. 12. The closure system connection 1200 is shown installed on the intermediate joint 1100 of FIG. 11, but can be applied to nodal joints 1000 (see FIGS. 10A–10B) as well. As can be seen, a gusset cover 1202 of the closure system connection 1200 is attached to and covers the top gusset plate 1104 and panel ends. A plurality of panels 1204 cover the openings defined by the intermediate lattice I-beams struts 1102. The panels 1204 may be made of a material such as glass, aluminum, Plexiglas, or other suitable materials. Battens or strut covers 1206 secure the panels 1204 to the intermediate lattice I-beams 1102. The battens 1206 may be extruded aluminum, plastic, or the like. All panel attachments are made via bolts, fasteners, screws, nuts, or other similar attachment means known to those of ordinary skill in the art, indicated generally at 1208.

Figure 13:
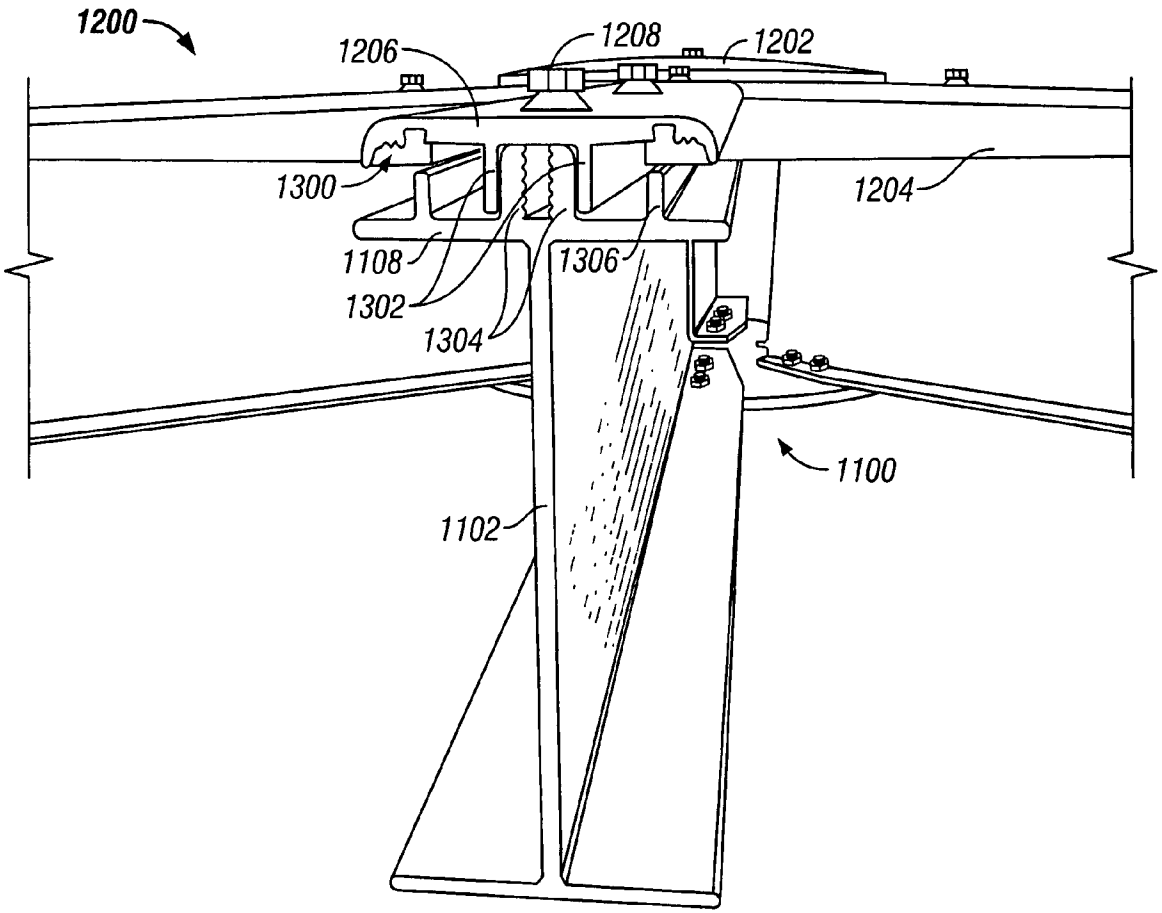
FIG. 13 illustrates an exemplary closure system connection according to embodiments of the invention.

A more detailed view of the battens or strut covers 1206 is illustrated in FIG. 13. As can be seen, a pair of gaskets 1300 running in parallel along the length of each strut cover 1206 is used to seal the cover panel 1204 to the strut covers 1206. The gaskets 1300 may be, for example, Neoprene gaskets. The battens or strut covers 1206 may further include a pair of protrusions 1302 that fit over a screw chase 1304 formed on top of the flange 1108 of the intermediate lattice I-beams 1102. The protrusions 1302 serve as a guide to align the battens or strut covers 1206 on the flange 1108 and facilitates placement of the attachment means 1208 (e.g., bolts, fasteners, screws, nuts, and the like) into the screw chase 1304. A pair of flange extrusion 1306 running parallel along the length of the intermediate lattice I-beams helps supports the battens or strut covers 1206.

An exemplary method of constructing the reticulated frame structure of the invention includes first constructing a series of subassemblies at ground level. Each subassembly has an external network and a lower strut frequency internal network spaced apart by diagonal struts. The subassemblies for the outermost portions of the reticulated frame structure are then positioned at a desired elevation and position, which is preferably its final position, relative to the foundation, and are supported by suitable shoring. For example, if constructing a dome shaped reticulated structure, it often will be convenient to assemble subassemblies of the entire perimeter section at ground level. Then, one can elevate, position, and connect the subassemblies to the perimeter foundation or other support structure, and then connect subassemblies to each other until the perimeter section is completed. Internal subassemblies of the structure are then assembled at ground level and raised into position relative to the previously erected subassemblies by a crane or cranes. The internal subassemblies are then attached in the desired place to the previously erected portion of the structure and supported with additional shoring, if required. Several internal subassemblies are preferably raised and attached substantially simultaneously, and preferably the internal subassemblies are attached so that the edges of construction of the structure are substantially the same height. The subassemblies are constructed so that they include a double layer module connected with diagonal struts in at least three sides, but larger subassemblies are preferred. Further subassemblies are repeatedly constructed and attached to the previous subassemblies until the structure is completed.

Whether assembling the subassemblies or the entire reticulated frame structure, the external network nodes that outline the intersection of external network chord struts can be defined by projecting the corresponding nodes of the internal network upward. The projection is performed along a line normal to the external network at the corresponding internal network node location. Once the geometry of the external and internal networks are defined as outlined above, each principal direction of the two way struts defines substantially parallel chord struts in both the external and internal networks. In the external network, intermediate lattice struts can then be added on the surface defined by the chord struts to form a three dimensional space frame.

The grid of connecting diagonal struts is defined so that, at any intersection of the chord struts, the intersecting chord struts are connected via nodal joints, and the diagonal struts running in one direction are not connected to the diagonal struts running in the other direction. Furthermore, the grid of diagonal strut is defined so that, at any given chord strut intersection, the diagonal struts running in one direction connect to the external nodal joint, and the diagonal struts running in the other direction connect at the corresponding internal nodal joint. This layout allows for simple diagonal strut connections because the diagonal struts are connected directly to the chord struts instead of the nodal joint. Note that this type of connection is possible because the diagonal struts and chord struts in a given principal direction and at any given strut location are substantially in the same plane, and because of the alternating diagonal strut connection pattern described above.

Figure 14B:
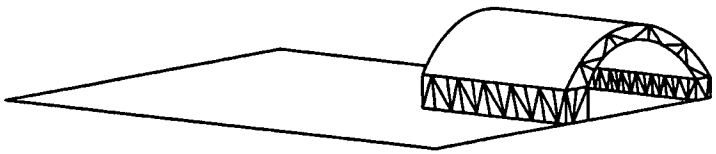
FIGS. 14A–14D illustrate an exemplary method for assembling a reticulated frame structure according to embodiments of the invention.
Figure 14D:
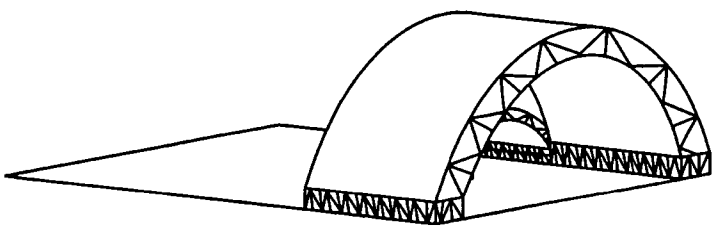
Figure 14A:
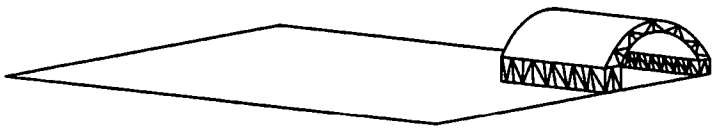
Figure 14C:
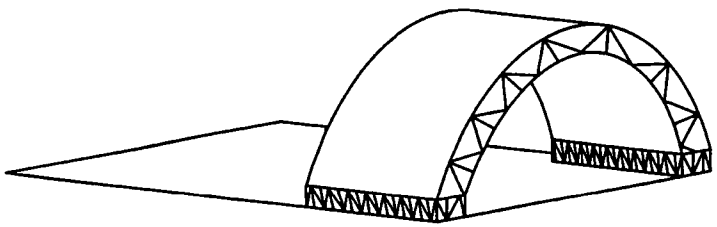

FIGS. 14A–D illustrate a portion of an assembly sequence for assembling structures used in large span roof applications such as airport hangars and large storage areas. For this type of applications, the roof supports are typically located at (or close to) ground level. The subassemblies for the structure are assembled at ground level in the manner described above. The structure can then be built starting from one end at which the structure is pinned or otherwise hinged (FIG. 14A). The partially assembled structure is then lifted (rotating at the pinned end), and the subassemblies are added to the partially assembled structure (FIGS. 14B). Lifting of the structure can be done with the aid of hydraulic jacks as required. This lifting and adding process can be repeated (FIG. 14C) until the structure can be connected at the other end (FIG. 14D).

As demonstrated by the foregoing, embodiments of the invention provide a method and apparatus for constructing a reticulated frame structure. While a limited number of embodiments have been disclosed herein, those of ordinary skill in the art will recognize that variations and modifications from the described embodiments may be derived without departing from the scope of the invention. Accordingly, the appended claims are intended to cover all such variations and modifications as falling within the scope of the invention.

I claim:

1. A double layer reticulated frame structure, comprising:

an internal network portion comprised of interconnected chord struts, the interconnected chord struts defining a two-way grid in the internal network portion;

an external network portion comprised of interconnected chord struts and intermediate lattice struts, the chord struts defining a two-way grid in the external network portion corresponding to the two-way grid of the internal network portion, and the intermediate lattice struts defining a plurality of openings in the two-way grid of the external network portion; and diagonal struts connected to the chord struts of the external and the internal network portions in an alternating manner along two directions such that diagonal struts along one internal chord strut direction are connected to the external and internal network portions at different nodes than diagonal struts along the other internal chord strut direction so that only two diagonal struts are connected to each other at any node in both the internal and internal network portions.

2. The double layer reticulated frame structure according to claim 1, wherein the chord struts and the intermediate lattice struts are I-beams.

3. The double layer reticulated frame structure according to claim 1, further comprising a nodal joint configured to connect the chord struts and the diagonal struts.

4. The double layer reticulated frame structure according to claim 3, wherein the nodal joint is configured to connect no more than two diagonal struts together.

5. The double layer reticulated frame structure according to claim 3, wherein the nodal joint is further configured to connect the intermediate lattice struts.

6. The double layer reticulated frame structure according to claim 5, wherein the nodal joint includes a top gusset plate and a bottom gusset plate configured to connect the chord struts and the intermediate lattice struts.

7. The double layer reticulated frame structure according to claim 3, wherein the nodal joint includes a front-side gusset plate and a back-side gusset plate configured to connect the diagonal struts.

8. The double layer reticulated frame structure according to claim 7, further comprising connectors configured to connect the front-side and the back-side gusset plates to the chord struts.

9. The double layer reticulated frame structure according to claim 8, wherein the connectors includes a predetermined one of channels and brackets.

10. The double layer reticulated frame structure according to claim 1, further comprising an intermediate joint configured to connect the intermediate lattice struts together.

11. The double layer reticulated frame structure according to claim 10, wherein the intermediate joint includes a top gusset plate and a bottom gusset plate configured to connect the intermediate lattice struts.

12. The double layer reticulated frame structure according to claim 7, further comprising a mid-chord joint configured to connect the diagonal struts to a midsection of the chord struts.

13. The double layer reticulated frame structure according to claim 12, wherein the mid-chord joint includes a front-side gusset plate and a back-side gusset plate configured to connect the diagonal struts.

14. The double layer reticulated frame structure according to claim 13, further comprising a channel or bracket configured to connect the front-side and the back-side gusset plates to the midsection of the chord struts.

15. The double layer reticulated frame structure according to claim 12, wherein the mid-chord joint includes a channel configured to connect the diagonal struts directly to the chord struts.

16. The double layer reticulated frame structure according to claim 1, wherein chord struts defining an enclosed area lie within different planes.

17. The double layer reticulated frame structure according to claim 16, wherein the enclosed area is bisected to form two planes.

18. The double layer reticulated frame structure according to claim 1, wherein the external network portion and the internal network portion have substantially the same nodal frequencies.

19. The double layer reticulated frame structure according to claim 1, wherein the external network portion has a higher strut frequency than the internal network portion.

20. The double layer reticulated frame structure according to claim 1, wherein all diagonal struts meeting at a given node in the external and internal network portions are coplanar.

21. A method of constructing a reticulated frame structure, comprising:

forming an internal network portion comprised of chord struts, the chord struts defining a two-way grid in the internal network portion;

forming an external network portion comprised of interconnected chord struts and intermediate lattice struts, the chord struts defining a two-way grid in the external network portion corresponding to the two-way grid of the internal network portion, and the intermediate lattice struts defining a plurality of openings in the two-way grid of the external network portion;

connecting diagonal struts to the chord struts of the internal and external network portion along two directions in an alternating manner such that the diagonal struts along one internal chord strut direction are connected to the internal and external network portions at different nodes than the diagonal struts along the other internal chord strut direction so that only two diagonal struts are connected to each other at any node in both the internal and internal network portions.

22. The method according to claim 21, further comprising assembling a plurality of subassemblies, each subassembly including the internal network portion and the external network portion connected together by the diagonal struts.

23. The method according claim 22, further comprising constructing a peripheral section of the reticulated frame structure using preselected ones of the subassemblies, and connecting other ones of the subassemblies to the peripheral section to form an inner section of the reticulated frame structure.

24. The method according to claim 23, wherein the subassemblies are assembled at ground level, then raised to a desired elevation.

25. The method according to claim 23, wherein the step of constructing a peripheral section includes attaching the preselected ones of the subassemblies to a support structure.

26. The method according to claim 21, wherein the step of connecting includes connecting no more than two diagonal struts to any joint in the internal or external network portions.

27. The method according to claim 22, wherein the step of assembling includes hinging a first end of a first subassembly to a support structure, lifting a second end of the first subassembly, connecting a first end of another subassembly to the second end of the first subassembly, and resting a second end of the other subassembly on the support structure.

28. A reticulated frame structure having an internal network portion and an external network portion, the external network portin comprised of chord struts interconnected to define a two-way grid and further comprised of intermediate lattice struts interconnected to define a plurality of openings in the two-way grid, comprising:

chord struts in the internal network portion interconnected to define a two-way grid corresponding to the two-way grid of the external network portion; and diagonal struts connected to the chord struts of the external and the internal network portins in an alternating manner along two directions such that diagonal struts along one internal chord strut direction are connected to the external and internal network portions at different nodes than diagonal struts along the other internal chord strut direction so that only two diagonal struts are connected to each other at any node in both the internal and internal network portions.

29. The reticulated frame structure according to claim 28, further comprising a nodal joint configured to connect the chord struts and the diagonal struts.

30. The reticulated frame structure according to claim 29, wherein the nodal joint is configured to connect no more than two diagonal struts.

31. The reticulated frame structure according to claim 29, wherein the nodal joint is further configured to connect the intermediate lattice struts.

32. The reticulated frame structure according to claim 31, wherein the nodal joint includes a top gusset plate and a bottom gusset plate configured to connect the chord struts and the intermediate lattice struts.

33. The reticulated frame structure according to claim 29 wherein the nodal joint includes a front-side gusset plate and a back-side gusset plate configured to connect the diagonal struts.

34. The reticulated frame structure according to claim 33, further comprising connectors configured to connect the front-side and the back-side gusset plates to the chord struts.

35. The reticulated frame structure according to claim 34, wherein the connectors include a predetermined one of channels and brackets.

36. The reticulated frame structure according to claim 35, further comprising connectors configured to connect the front-side and the back-side gusset plates to the midsection of the chord struts.

37. The double layer reticulated frame structure according to claim 33, further comprising a mid-chord joint configured to connect the diagonal struts to a midsection of the chord struts.

38. The reticulated frame structure according to claim 37, wherein the mid-chord joint includes a front-side gusset plate and a back-side gusset plate configured to connect the diagonal struts.

39. The reticulated frame structure according to claim 37, wherein the mid-chord joint includes a connector configured to connect the diagonal struts directly to the chord struts.

40. The reticulated frame structure according to claim 28, further comprising an intermediate joint configured to connect the intermediate lattice struts.

41. The double layer reticulated frame structure according to claim 40, wherein the intermediate joint includes a top gusset plate and a bottom gusset plate configured to connect the intermediate lattice struts.

42. The reticulated frame structure according to claim 28, wherein chord struts defining an enclosed area lie within different planes.

43. The reticulated frame structure according to claim 42, wherein the enclosed area is bisected to form two planes.

44. The reticulated frame structure according to claim 28, wherein the external network portion and the internal network portion have substantially the same nodal frequencies.

45. The reticulated frame structure according to claim 28, wherein the external network portion has a higher strut frequency than the internal network portion.

46. A double layer reticulated frame structure, comprising:

an internal network portion comprised of interconnected chord struts; and an external network portion comprised of interconnected chord struts and intermediate lattice struts;

wherein the interconnected chord struts of the internal and external network portions define corresponding two-way grids in the internal and external network portions, respectively, and the intermediate lattice struts define a plurality of openings in the two-way grid of the external network portion; and diagonal struts connected to the chord struts of the external and the internal network portions in an alternating manner along two directions such that diagonal struts along one internal chord strut direction are connected to the external and internal network portions at different nodes than diagonal struts along the other internal chord strut direction so that only two diagonal struts are connected to each other at any node in both the internal and internal network portions.

* * * * *